US012152589B2

(12) United States Patent
Zhuo et al.

(10) Patent No.: US 12,152,589 B2
(45) Date of Patent: Nov. 26, 2024

(54) COMPRESSOR AND AIR CONDITIONING SYSTEM

(71) Applicant: GREE ELECTRIC APPLIANCES, INC. OF ZHUHAI, Guangdong (CN)

(72) Inventors: Mingsheng Zhuo, Zhuhai (CN); Cong Cao, Zhuhai (CN); Yushi Bi, Zhuhai (CN); Furong Hou, Zhuhai (CN); Qiangjun Meng, Zhuhai (CN)

(73) Assignee: GREE ELECTRIC APPLIANCES, INC. OF ZHUHAI, Ghuangdong (CN)

( * ) Notice: Subject to any disclaimer, the term of this patent is extended or adjusted under 35 U.S.C. 154(b) by 340 days.

(21) Appl. No.: 17/575,451

(22) Filed: Jan. 13, 2022

(65) Prior Publication Data

US 2022/0136507 A1 May 5, 2022

Related U.S. Application Data

(63) Continuation-in-part of application No. PCT/CN2020/096826, filed on Jun. 18, 2020.

(30) Foreign Application Priority Data

Jul. 29, 2019 (CN) ..... 201910690146.6

(51) Int. Cl.
*F04C 28/12* (2006.01)
*F04C 14/02* (2006.01)
(Continued)

(52) U.S. Cl.
CPC ..... *F04C 23/001* (2013.01); *F04C 14/02* (2013.01); *F04C 28/24* (2013.01); *F04C 28/28* (2013.01); *F04C 29/124* (2013.01)

(58) Field of Classification Search
CPC ..... F04C 23/001; F04C 28/24; F04C 28/28; F04C 28/12; F04C 28/124; F04C 29/124; F04C 14/02
See application file for complete search history.

(56) References Cited

U.S. PATENT DOCUMENTS

2015/0292762 A1* 10/2015 Clanin ..... G05B 15/02 700/276
2018/0017059 A1* 1/2018 Johnson ..... F04C 18/16

FOREIGN PATENT DOCUMENTS

CN 101487471 A 7/2009
CN 103411338 A 11/2013
(Continued)

OTHER PUBLICATIONS

Englsih CN104912800 by PE2E Feb. 7, 2024.*
A copay of GB 2331788 by PE2E Jul. 10, 2024.*

*Primary Examiner* — Deming Wan
(74) *Attorney, Agent, or Firm* — J. Miguel Hernandez; James R. Gourley; Carstens, Allen & Gourley, LLP

(57) ABSTRACT

A compressor and an air conditioning system. The compressor includes two compressing structures and an intermediate gas supplement structure. A communication pipe is provided between a gas exhaustion port of one compressing structure and a gas suction port of another compressing structure in the two compressing structures. The intermediate gas supplement structure is in communication with the communication pipe. At least one compressing structure is provided with a gas supplement structure. In the compressor and the air conditioning system, the gas supplement structure is provided to at least one compressing structure, so that at least two levels of gas supplement to the compressor are provided.

10 Claims, 2 Drawing Sheets

(51) Int. Cl.

| | |
|---|---|
| ***F04C 23/00*** | (2006.01) |
| ***F04C 28/24*** | (2006.01) |
| ***F04C 28/28*** | (2006.01) |
| ***F04C 29/12*** | (2006.01) |

(56) References Cited

FOREIGN PATENT DOCUMENTS

| | | | | | |
|---|---|---|---|---|---|
| CN | 105065281 | A | | 11/2015 | |
| CN | 205580047 | U | | 9/2016 | |
| CN | 104912800 | B | * | 3/2017 | ..... F04C 28/12 |
| CN | 106949051 | A | | 7/2017 | |
| CN | 108869304 | A | | 11/2018 | |
| CN | 110285060 | A | | 9/2019 | |
| CN | 210799361 | U | | 6/2020 | |
| GB | 2331788 | A | * | 6/1999 | ..... F04C 23/001 |
| JP | 2000337283 | A | | 12/2000 | |

* cited by examiner

COMPRESSOR AND AIR CONDITIONING SYSTEM

This application is a continuation-in-part under 35 U.S.C. § 120 of international patent application PCT/CN2020/096826, filed on Jun. 18, 2020 titled "Compressor and Air Conditioning System," published on Feb. 4, 2021, as WO 2021/017677 A1, which claims the benefit of the priority of China Patent Application No. 201910690146.6, filed on Jul. 29, 2019. Every application and publication listed in this paragraph is hereby incorporated herein by reference in its entirety as an example.

TECHNICAL FIELD

The present disclosure relates to the technical field of air conditioning equipment, and particularly relates to a compressor and an air conditioning system.

BACKGROUND

In order to improve energy efficiency of a screw compressor, a gas supplement device can be installed on the compressor to increase the cooling capacity and improve the overall energy efficiency. In the related art known to the inventors, a common solution is to provide a supplemental gas inlet on a slide valve and introduce additional refrigerant into a rotor compression chamber through the slide valve. In this way, due to the limitation of the volume of a slide valve cavity, the amount of supplemented gas is relatively small, generally around 10%. The single-body two-stage screw compressor adopts two rotors, and the gas supplement can be located at the place between gas exhaustion of the first stage and gas suction of the second stage. As the space in the compressor housing is relatively large, the amount of supplemented gas can be increased to more than 20%. However, the supplemental gas inlet is generally disposed at the low-pressure-stage or a middle portion of the housing, and the pressure of the supplemental gas is difficult to control.

SUMMARY

According to the research of the inventors, in the compressor in related art, the amount of supplemented gas is relatively small, and the pressure of the supplemental gas is difficult to control.

In view of this, embodiments of the present disclosure provide a compressor and an air conditioning system, which can increase the amount of supplemented gas and facilitate the control of the supplemental gas pressure.

Some embodiments of the present disclosure provide a compressor, including:

two compressing structures; and an intermediate gas supplement structure;

wherein a communication pipe is provided between a gas exhaustion port of one compressing structure and a gas suction port of another compressing structure in the two compressing structures, the intermediate gas supplement structure is directly or indirectly communicated with the communication pipe, and at least one compressing structure is provided with a gas supplement structure.

In some embodiments, the two compressing structures each include a rotor chamber, the rotor chamber is provided with a rotor chamber supplemental gas inlet, and the rotor chamber supplemental gas inlet forms the gas supplement structure.

In some embodiments, the compressing structure further includes a slide valve, the slide valve is provided with a slide valve cavity supplemental gas inlet, the slide valve cavity supplemental gas inlet and the rotor chamber supplemental gas inlet together form the gas supplement structure; in the same gas supplement structure, a supplemental gas pressure of the slide valve cavity supplemental gas inlet and a supplemental gas pressure of the rotor chamber supplemental gas inlet are equal to each other.

In some embodiments, wherein the slide valve is a capacity slide valve, the slide valve cavity supplemental gas inlet and the rotor chamber supplemental gas inlet are in the same working condition.

In some embodiments, the slide valve is an inner volume ratio adjusting slide valve, and the slide valve cavity supplemental gas inlet and the rotor chamber supplemental gas inlet work independently with respect to each other.

In some embodiments, a peripheral side of the rotor chamber is provided with a plurality of through holes, and the through holes are all aligned along a helically rotating direction of a rotor in the rotor chamber.

In some embodiments, the two compressing structures include a low-pressure-stage compressor body and a high-pressure-stage compressor body; the low-pressure-stage compressor body is provided with a low-pressure-stage gas supplement structure, the high-pressure-stage compressor body is provided with a high-pressure-stage gas supplement structure; a suction pressure of the low-pressure-stage the compressor body is smaller than a supplemental gas pressure of the low-pressure-stage gas supplement structure, the supplemental gas pressure of the low-pressure-stage gas supplement structure is smaller than a supplemental gas pressure of the intermediate gas supplement structure, the supplemental gas pressure of the intermediate gas supplement structure is smaller than a suction pressure of the high-pressure-stage compressor body, and the suction pressure of the high-pressure-stage compressor body is smaller than a supplemental gas pressure of the high-pressure-stage gas supplement structure.

In some embodiments, the low-pressure-stage compressor body includes an exhaustion chamber, the exhaustion chamber is provided with a low-pressure gas exhaustion port, the intermediate gas supplement structure is communicated with the exhaustion chamber, and a gas outflow direction of the intermediate gas supplement pipeline is directed to the low-pressure gas exhaustion port.

In some embodiments, the compressor further includes a detection module, and the detection module is configured to detect and adjust a supplemental gas pressure of the gas supplement structure.

In some embodiments, the compressor further includes a detection module, and the detection module is configured to detect and adjust a supplemental gas pressure of the intermediate gas supplement pipeline.

In some embodiments, the compressor further includes a detection module, and the detection module is configured to detect and adjust a supplemental gas pressure of the gas supplement structure and a supplemental gas pressure of the intermediate gas supplement pipeline.

In some embodiments, capacities of the two compressing structures are equal to each other.

Some embodiments of the present disclosure provide an air conditioning system, including the above-described compressor.

Therefore, according to the embodiments of the present disclosure, the gas supplement structure is provided to at least one compressing structure, so that at least two levels of gas supplement to the compressor is achieved, which effectively increases the amount of gas that is supplemented to the compressor, and can make the control on the supplemental gas pressure more precise. The gas supplement is diversified and thus effectively improves the energy efficiency of the compressor and expands the application scope of the compressor.

DESCRIPTION OF REFERENCE SIGNS

1. compressing structure; 2. intermediate gas supplement structure; 11. rotor chamber supplemental gas inlet; 12. slide valve cavity supplemental gas inlet; 3. low-pressure-stage compressor body; 4. high-pressure-stage compressor body; 10. communication pipe; 102. gas exhaustion port; 104. gas suction port; 106. rotor chamber; 108. slide valve; 120. exhaustion chamber.

DETAILED DESCRIPTION

The present disclosure will now be described in detail with reference to the accompanying drawings and embodiments in order to make the objects, technical solutions, and advantages of the present disclosure more clear. It should be understood that the specific embodiments described herein are only for explaining the present disclosure, and not intended to limit the present disclosure.

For the intermediate gas supplement structure of a single-body two-stage screw compressor, an intermediate supplemental gas inlet, whose supplemental gas pressure is slightly higher than the intermediate pressure, is generally located at the intermediate pressure stage between the low pressure stage and the high pressure stage. The intermediate pressure varies with the suction and exhaust conditions, and the intermediate pressure is affected by a pressure ratio between the two stages. The intermediate gas supplement is not affected by partial load, and the supplemental gas pressure fluctuates greatly, the system is difficult to control although the amount of supplemental gas can be increased. The slide valve supplemental gas inlet is generally located on the compressor body, and gas enters the compression cavity formed between the tooth grooves of the female rotor and the male rotor through the hole located on the slide valve. The supplemental gas pressure is generally the pressure at the second tooth groove, which is slightly greater than the suction pressure. The supplemental gas pressure is only affected by the suction pressure, and the control thereof is relatively stable. However, at the partial load condition, due to the bypass effect, the gas supplement efficiency is reduced, and when the load is too low, gas supplement cannot be carried out and energy efficiency cannot be improved.

Figure 1:
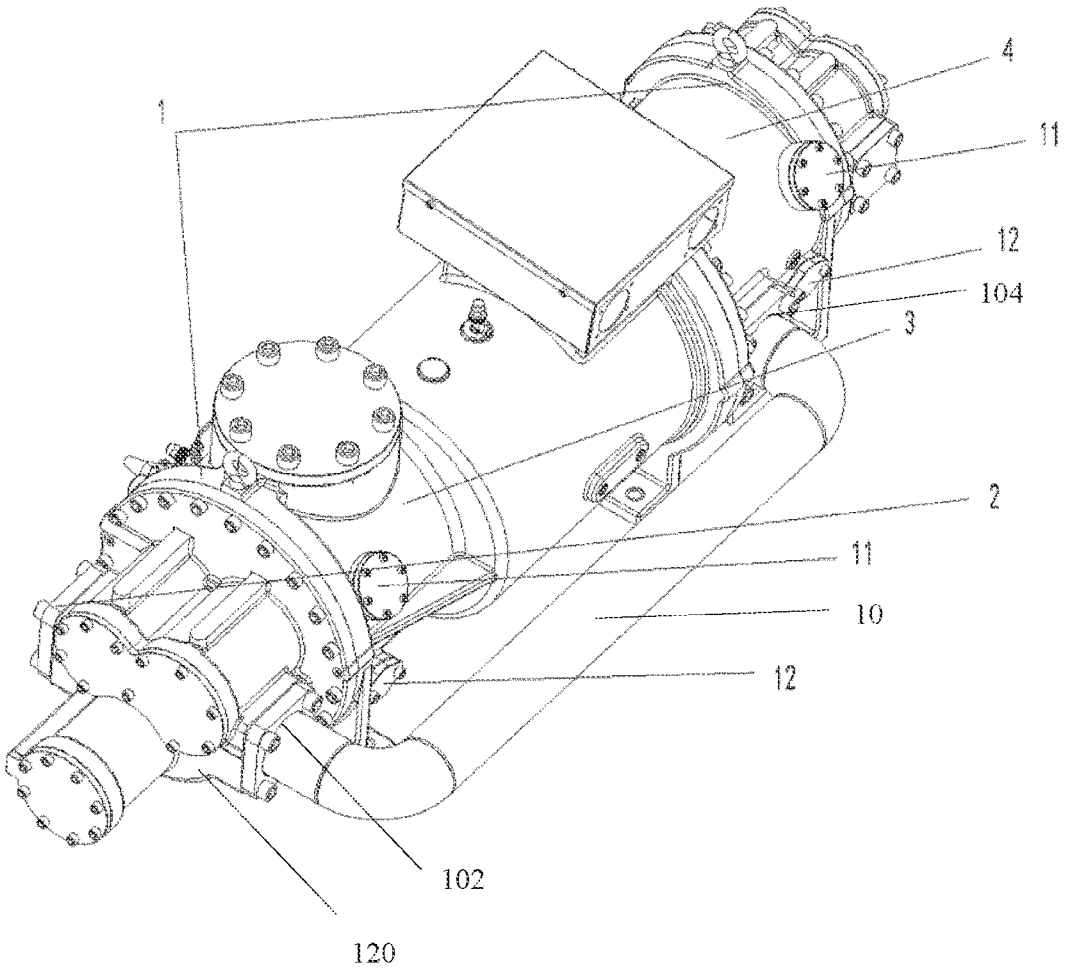
FIG. 1 is a schematic structural view of a compressor according to some embodiments of the present disclosure.
Figure 2:
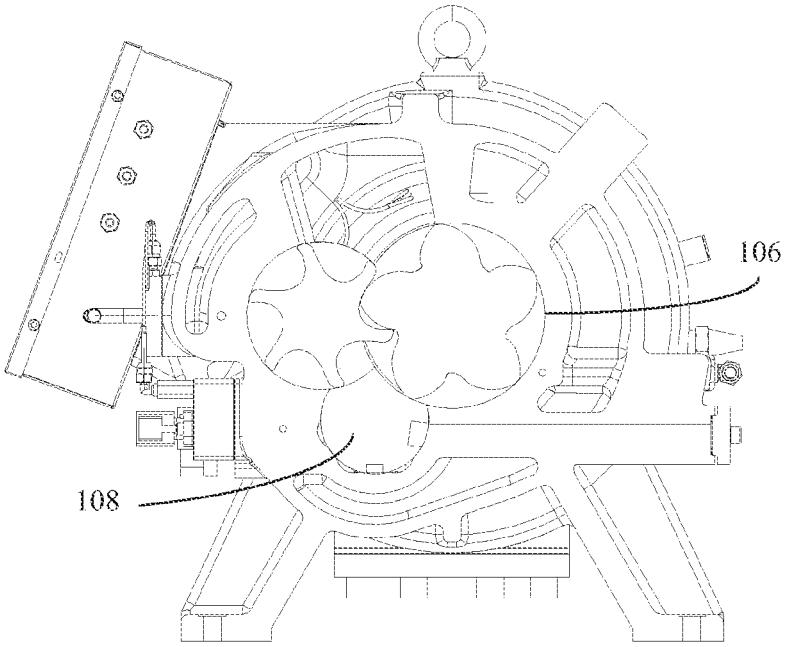
FIG. 2 is a cross sectional view of the compressor according to some embodiments of the present disclosure.

In view of this, an embodiment of the present disclosure provides a compressor. Referring to FIG. 1, the compressor includes two compressing structures 1 and an intermediate gas supplement structure 2. A communication pipe 10 is provided between a gas exhaustion port 102 of one compressing structure 1 and a gas suction port 104 of another compressing structure 1 in the two compressing structures 1. The intermediate gas supplement structure 2 is directly or indirectly communicated with the communication pipe 10. At least one compressing structure 1 is provided with a gas supplement structure. By having the gas supplement structure and the intermediate gas supplement structure 2, at least two levels of gas supplement to the compressor is achieved, which effectively increases the amount of gas that is supplemented to the compressor. Moreover, compared to the related art which simply adopts the intermediate gas supplement structure 2, the multi-levels of gas supplement structures can mutually affect each other, thereby effectively increasing the amount of supplemented gas to the compressor and being capable of making the control on the supplemental gas pressure more precise. The gas supplement is diversified and thus effectively improves the energy efficiency of the compressor and expands the application scope of the compressor.

In some embodiments, referring to FIG. 1, the compressing structure 1 includes a rotor chamber 106. The rotor chamber 106 is provided with a rotor chamber supplemental gas inlet 11, and the rotor chamber supplemental gas inlet 11 forms the gas supplement structure, thereby utilizing the rotor chamber supplemental gas inlet 11 to introduce supplemental gas when the compressing structures 1 operate in a full load condition.

Referring to FIG. 1, in some embodiments, the compressing structure 1 further includes a slide valve 108. The slide valve 108 is provided with a slide valve cavity supplemental gas inlet 12. The slide valve cavity supplemental gas inlet 12 and the rotor chamber supplemental gas inlet 11 together form the gas supplement structure. In the same gas supplement structure, a supplemental gas pressure of the slide valve cavity supplemental gas inlet 12 and a supplemental gas pressure of the rotor chamber supplemental gas inlet 11 are equal to each other, so that the slide valve cavity supplemental gas inlet 12 and the rotor chamber supplemental gas inlet 11 cooperates with each other to provide supplemental gas by multiple ways for one compressing structure 1 to increase the amount of supplemented gas.

In some embodiments, referring to FIG. 1, the slide valve 108 is a capacity slide valve. The slide valve cavity supplemental gas inlet 12 and the rotor chamber supplemental gas inlet 11 are in the same working condition. That is, in gas supplement, gas is simultaneously supplemented from the slide valve cavity supplemental gas inlet 12 and the rotor chamber supplemental gas inlet 11.

Referring to FIG. 1, in some embodiments, the slide valve 108 is an inner volume ratio adjusting slide valve, and the slide valve cavity supplemental gas inlet 12 and the rotor chamber supplemental gas inlet 11 work independently with respect to each other. Since there is no partial load, the rotor chamber supplemental gas inlet 11 can be used alone to introduce supplemental gas.

In some embodiments, a peripheral side of the rotor chamber 106 is provided with a plurality of through holes, and the through holes are all aligned along a helically rotating direction of a rotor in the rotor chamber 106.

Referring to FIG. 1, in some embodiments, the two compressing structures 1 include a low-pressure-stage compressor body 3 and a high-pressure-stage compressor body 4. The low-pressure-stage compressor body 3 is provided with a low-pressure-stage gas supplement structure. The high-pressure-stage compressor body 4 is provided with a high-pressure-stage gas supplement structure. A suction pressure of the low-pressure-stage the compressor body 3 is smaller than a supplemental gas pressure of the low-pressure-stage gas supplement structure. The supplemental gas pressure of the low-pressure-stage gas supplement structure is smaller than a supplemental gas pressure of the intermediate gas supplement structure 2. The supplemental gas pressure of the intermediate gas supplement structure 2 is smaller than a suction pressure of the high-pressure-stage compressor body 4. The suction pressure of the high-pressure-stage compressor body 4 is smaller than a supplemental gas pressure of the high-pressure-stage gas supplement structure.

In some embodiments, referring to FIG. 1, the low-pressure-stage compressor body 3 includes an exhaustion chamber 120. The exhaustion chamber 120 is provided with a low-pressure gas exhaustion port 102. The intermediate gas supplement structure 2 is communicated with the exhaustion chamber 120. A gas outflow direction of the intermediate gas supplement pipeline is directed to the low-pressure gas exhaustion port 102. In fluctuation of the gas suction and exhaust conditions, the low-temperature refrigerant can simultaneously cool the first-stage exhausted gas, reduce the superheat degree of the first-stage exhausted gas, and improve energy efficiency.

In some embodiments, the compressor further includes a detection module, and the detection module is configured to detect and adjust a supplemental gas pressure of the gas supplement structure. In some embodiments, the detection module is configured to detect and adjust a supplemental gas pressure of the intermediate gas supplement pipeline. In some embodiments, the detection module is configured to detect and adjust a supplemental gas pressure of the gas supplement structure and a supplemental gas pressure of the intermediate gas supplement pipeline. The supplemental gas pressure at different locations is affected by multiple factors. The low-pressure-stage gas supplement affects the intermediate supplemental gas pressure. The intermediate supplemental gas pressure then affects the high-pressure-stage supplemental gas pressure. The high-pressure-stage supplemental gas pressure affects the pressure of gas exhaustion pressure, and thus affects the intermediate gas pressure. By setting suitable detection sites and detecting pressure changes at different locations, the optimal pressure distribution for each working condition can be found, so that the compressor can operate at the best energy efficiency state. The detection sites can be located on a supplemental gas pipeline in the rotor chamber, a supplemental gas pipeline running out from the slide valve cavity, or the intermediate gas supplement pipeline. External sensors can be used to realize the detection process. The detection module adjusts the supplemental gas pressure at the low-pressure stage, the intermediate supplemental gas pressure, and the supplemental gas pressure at the high-pressure stage according to the detection results to increase the gas supplement accuracy of the compressor. Alternatively, the detection module uploads the detection results to the corresponding module in the system, and the corresponding module adjusts the supplemental gas pressure at the low-pressure stage, the intermediate supplemental gas pressure, and the supplemental gas pressure at the high-pressure stage to increase the gas supplement accuracy of the compressor.

In some embodiments, capacities of the two compressing structures 1 are equal to each other. Different capacity matching relationships can be realized by supplementing gas, so as to meet various needs for cooling capacity, broaden operating range and applicable environment of the compressor, and improve versatility and compatibility of the compressor.

Some embodiments of the present disclosure provide an air conditioning system including the aforementioned compressor.

The above-described embodiments are only several implementations of the present disclosure, and the descriptions are relatively specific and detailed, but they should not be construed as limiting the scope of the present disclosure. It should be understood by those of ordinary skill in the art that various modifications and improvements can be made without departing from the concept of the present disclosure, and all fall within the protection scope of the present disclosure. Therefore, the patent protection of the present disclosure shall be defined by the appended claims.

What is claimed is:

1. A compressor, comprising:

two compressing structures; and an intermediate gas supplement structure;

wherein a communication pipe is provided between a gas exhaustion port of one of the compressing structures and a gas suction port of another of the two compressing structures, the intermediate gas supplement structure is directly or indirectly communicated with the communication pipe, and at least one of the compressing structures is provided with a gas supplement structure, wherein the two compressing structures each comprise a rotor chamber, the rotor chamber is provided with a rotor chamber supplemental gas inlet, and the rotor chamber supplemental gas inlet forms the gas supplement structure and each of the compressing structures further comprises a slide valve, the slide valve is provided with a slide valve cavity supplemental gas inlet, the slide valve cavity supplemental gas inlet and the rotor chamber supplemental gas inlet together form the gas supplement structure, in the same gas supplement structure, a supplemental gas pressure of the slide valve cavity supplemental gas inlet and a supplemental gas pressure of the rotor chamber supplemental gas inlet are equal to each other.

2. The compressor according to claim 1, wherein the slide valve is a capacity slide valve, and the slide valve cavity supplemental gas inlet and the rotor chamber supplemental gas inlet are in the same working condition.

3. The compressor according to claim 1, wherein the slide valve is an inner volume ratio adjusting slide valve, and the slide valve cavity supplemental gas inlet and the rotor chamber supplemental gas inlet work independently with respect to each other.

4. The compressor according to claim 1, wherein each of the two compressing structures comprises a low-pressure-stage compressor body and a high-pressure-stage compressor body; the low-pressure-stage compressor body is provided with a low-pressure-stage gas supplement structure, the high-pressure-stage compressor body is provided with a high-pressure-stage gas supplement structure; a suction pressure of the low-pressure-stage compressor body is smaller than a supplemental gas pressure of the low-pressure-stage gas supplement structure, the supplemental gas pressure of the low-pressure-stage gas supplement structure is smaller than a supplemental gas pressure of the intermediate gas supplement structure, the supplemental gas pressure of the intermediate gas supplement structure is smaller than a suction pressure of the high-pressure-stage compressor body, and the suction pressure of the high-pressure-stage compressor body is smaller than a supplemental gas pressure of the high-pressure-stage gas supplement structure.

5. The compressor according to claim 4, wherein the low-pressure-stage compressor body comprises an exhaustion chamber, the exhaustion chamber is provided with a low-pressure gas exhaustion port, the intermediate gas supplement structure is communicated with the exhaustion chamber, and a gas outflow direction of the intermediate gas supplement pipeline is directed to the low-pressure gas exhaustion port.

6. The compressor according to claim 1, further comprising a detection module, wherein the detection module is configured to detect and adjust a supplemental gas pressure of the gas supplement structure.

7. The compressor according to claim 1, further comprising a detection module, wherein the detection module is configured to detect and adjust a supplemental gas pressure of the intermediate gas supplement pipeline.

8. The compressor according to claim 1, further comprising a detection module, wherein the detection module is configured to detect and adjust a supplemental gas pressure of the gas supplement structure and a supplemental gas pressure of the intermediate gas supplement pipeline.

9. The compressor according to claim 1, wherein capacities of the two compressing structures are equal to each other.

10. An air conditioning system, comprising the compressor according to claim 1.

* * * * *